US009504299B2

(12) United States Patent
Ma

(10) Patent No.: US 9,504,299 B2
(45) Date of Patent: Nov. 29, 2016

(54) TELESCOPIC UMBRELLA STRUCTURE

(71) Applicant: Oliver Joen-an Ma, Arcadia, CA (US)

(72) Inventor: Oliver Joen-an Ma, Arcadia, CA (US)

( * ) Notice: Subject to any disclaimer, the term of this patent is extended or adjusted under 35 U.S.C. 154(b) by 0 days.

(21) Appl. No.: 14/595,832

(22) Filed: Jan. 13, 2015

(65) Prior Publication Data

US 2015/0223578 A1 Aug. 13, 2015

(30) Foreign Application Priority Data

Jan. 13, 2014 (CN) ..... 2014 2 0017942 U

(51) Int. Cl.
*A45B 19/06* (2006.01)
*A45B 25/02* (2006.01)

(52) U.S. Cl.
CPC ..... *A45B 19/06* (2013.01); *A45B 25/02* (2013.01)

(58) Field of Classification Search
CPC ..... A45B 25/02; A45B 19/04; A45B 19/06; A45B 19/10; A45B 2009/007; A63C 11/221; Y10T 403/32467; Y10T 403/32501
USPC ..... 135/15.1, 23, 25.1, 25.3, 25.33, 26, 31, 135/75; 403/109.1–109.3, 109.5
See application file for complete search history.

(56) References Cited

U.S. PATENT DOCUMENTS 1,856,385 A 5/1932 Haupt
4,011,881 A * 3/1977 Becher ..... A45B 25/143 135/20.3
5,897,268 A * 4/1999 Deville ..... F16B 7/1463 403/109.1
6,250,839 B1 * 6/2001 Lenhart ..... A63C 11/221 135/75
RE38,635 E * 10/2004 Uemura ..... F16B 7/1427 135/69
7,134,442 B2 11/2006 Ma
7,849,867 B2 12/2010 Takayama
(Continued)

FOREIGN PATENT DOCUMENTS

CN 2498887 Y 7/2002
CN 101224059 A 7/2008

OTHER PUBLICATIONS

Extended European Search Report issued in European Application No. 15151026.0, dated Jun. 10, 2015.

*Primary Examiner* — Winnie Yip
(74) *Attorney, Agent, or Firm* — Knobbe, Martens, Olson & Bear, LLP

(57) ABSTRACT

This utility model involves a telescopic tube structure of an umbrella rib, comprising an outer tube and an inner tube of the long rib, and the left end of the inner tube of the long rib is flexibly seated inside the outer tube of the long rib, the inner tube of the long rib is connected to a locking pin, the outer tube of the long rib is equipped with corresponding grooves, and the inner tube of the long rib is fixed to the outer tube of the long rib when the locking pin is inserted into the groove; when the locking pin detaches from the groove, the inner tube of the long rib will move axially back and forth with respect to the outer tube of the long rib. The inner tube of the long rib is further provided with wedges, and the beveled side of the wedge matches the beveled side of the locking pin. The structure of a telescopic tube structure of an umbrella rib is adopted, which is structurally simple. The wedge with the beveled side pushes the locking pin that also has a beveled side, allowing the locking pin to detach or insert into the groove. It is very convenient to use, wherein the inner tube of the long rib remains flexibly connected when the movable block is pushed to the left, and the release of the movable block allows the inner tube and outer tube of the long rib to remain securely fixed to one another and reliably locked. The number of grooves and the distance between grooves can be adjusted to suit different needs.

12 Claims, 1 Drawing Sheet

(56) References Cited

U.S. PATENT DOCUMENTS

| | | | | |
|---|---|---|---|---|
| 8,215,863 | B2 * | 7/2012 | Sohn | A45B 9/00 135/75 |
| 8,251,078 | B2 | 8/2012 | Ma | |
| 8,967,170 | B1 * | 3/2015 | Lai | A45B 9/00 135/75 |
| 2003/0205262 | A1 * | 11/2003 | Woodward | A45B 15/00 135/16 |
| 2006/0062632 | A1 | 3/2006 | Jang | |
| 2008/0236640 | A1 | 10/2008 | Huali et al. | |
| 2010/0122718 | A1 * | 5/2010 | Lah | A45B 9/00 135/75 |
| 2014/0053887 | A1 * | 2/2014 | Lee | A45B 9/04 135/66 |
| 2015/0216274 | A1 * | 8/2015 | Akin | A45B 25/00 135/16 |

* cited by examiner

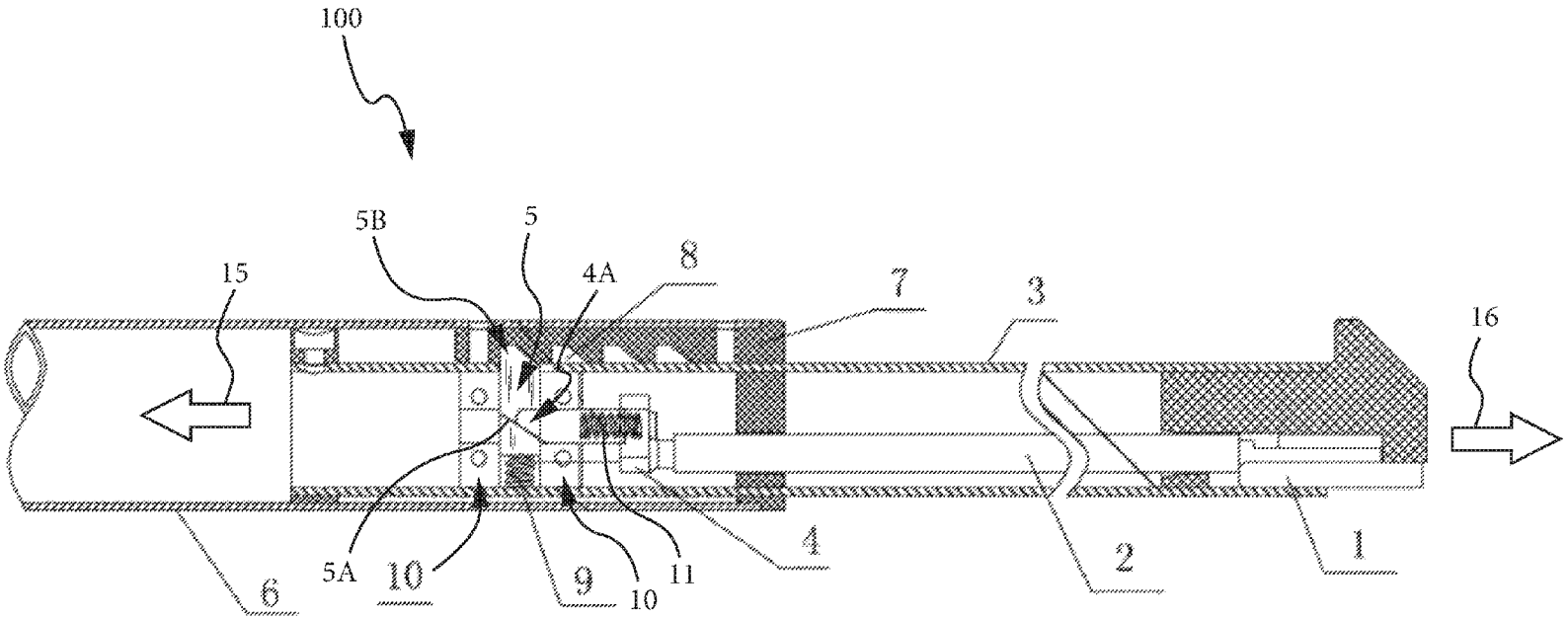
100
16
15
5B
5
4A
8
7
3
2
1
4
11
10
9
10
5A
6

TELESCOPIC UMBRELLA STRUCTURE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTION

Field of the Invention

This utility model involves the technical aspects of an umbrella, especially the technical aspects of the umbrella rib structure; this utility model specifically refers to the telescopic tube structure of an umbrella rib.

Description of the Related Art

The canopy of the majority of existing collapsible umbrellas is supported by several ribs, in order to achieve a shading effect. The tightness of the canopy needs to be adjusted over time as the canopy would become loose as a result of prolonged use. There are some telescopic rib structures available in the market, for example, the umbrella disclosed in patent ZL200810074398.8, of which only the long rib is equipped with a spring to adjust the inner rib of the long rib. Such an arrangement can only adjust the tightness of the canopy, but not allow for the inner bone of the rib to be retractable. Another example is the collapsible ribs of the sunshade disclosed in patent ZL01267618.7, of which the long rib is equipped with a flexible button to adjust the stretching and retracting of the inner rib. It is extremely inconvenient having to locate the button after installing the canopy to stretch or retract the inner rib of the umbrella rib. Thus, an adjustable telescopic tube structure of an umbrella rib is required. The structure must not only solve the problem of adjusting the tightness of the canopy, but must also be applicable to the retracting of the relatively long ribs during the closing of rectangle umbrellas, so as to overcome the height difference between the long umbrella ribs and the table below the umbrella.

SUMMARY OF THE INVENTION

The objective of this invention is to overcome the shortcomings of the prior technology mentioned above by providing a structurally simple and easy to assemble telescopic tube structure of an umbrella rib that can realize the stretching and retracting of the ribs.

In order to realize the aforementioned objective, the following technical solutions are adopted in the telescopic tube structure of an umbrella rib of this utility model:

The telescopic tube structure of an umbrella rib, wherein, comprises an outer tube and an inner tube of the long rib. The left end of the said inner tube of the long rib is flexibly seated inside the said outer tube of the long rib, the said inner tube of the long rib is connected to a locking pin, the said outer tube of the long rib is equipped with corresponding grooves, and the said inner tube of the long rib is fixed to the said outer tube of the long rib when the said locking pin is inserted into the said groove; when the said locking pin detaches from the said groove, the said inner tube of the long rib will move axially back and forth with respect to the said outer tube of the long rib.

The said inner tube of the long rib in the telescopic tube structure of the umbrella rib is further provided with wedges, which have a beveled side. The said locking pin is equipped with a matching beveled side. The beveled side of the said wedge matches the beveled side of the said locking pin. The axial movement of the said wedge with respect to the said inner tube of the long rib will drive the said locking pin to move back and forth along the diameter.

The inner wall of the said inner tube of the long rib in the telescopic tube structure of the umbrella rib is fixed with the first spring. One end of the said locking pin faces the said groove, while the other end of the said locking pin closely abuts the said first spring.

The inner wall of the said inner tube of the long rib in the telescopic tube structure of an umbrella rib is also fixed with a fastening block. The said locking pin gets flexibly connected to the said fastening block when it moves along the diameter. The said locking pin is fixed at its position by the said fastening block when it moves axially.

The inner wall of the said inner tube of the long rib in the telescopic tube structure of the umbrella rib is provided with a movable push rod. The left end of the movable push rod is connected and fixed to the said wedge.

The right end of the said inner tube of the long rib in the telescopic tube structure of the umbrella rib is provided with a movable block. The right end of the said movable push rod is connected and fixed to the movable block. The said movable block extends into the said inner tube of the long rib.

The second spring is located between the said fastening block and the said wedge in the telescopic tube structure of the umbrella rib. The two ends of the said second spring closely abut the said fastening block and the said wedge respectively.

There should be at least two of the said grooves in the telescopic tube structure of the umbrella rib, and the said grooves must be distributed axially along the inner surface of the said outer tube of the long rib.

The right end of the said outer tube of the long rib in the telescopic tube structure of the umbrella rib is fixed with a retractable block. The movement of the said wedge is limited by the retractable block when it moves axially to the right.

The structure of the telescopic tube structure of the umbrella rib is adopted, which is structurally simple. The wedge with the beveled side pushes the locking pin that also has a beveled side, allowing the locking pin to detach or insert into the groove. It is very convenient to use, wherein the inner tube of the long rib remains flexibly connected when the movable block is pushed to the left, and the release of the movable block allows the inner tube and outer tube of the long rib to remain securely fixed to one another and reliably locked. The number of grooves and the distance between grooves can be adjusted to suit different needs.

BRIEF DESCRIPTION OF THE DRAWINGS

FIG. 1 A schematic diagram of the umbrella stretcher of this utility model.

DETAILED DESCRIPTION OF THE PREFERRED EMBODIMENT

In order to have a clearer understanding of the technical content of this utility model, the following implementations are specially cited and described in detail.

Referring to FIG. 1, the telescopic tube structure of an umbrella rib comprises an Outer Tube 6 and an Inner Tube 3 of the long rib 100. The left end of Inner Tube 3 of the long rib is flexibly seated inside Outer Tube 6 of the long rib, Inner Tube 3 of the long rib is connected to a Locking Pin 5, Outer Tube 6 of the long rib is equipped with a plurality of corresponding Grooves 8, and Inner Tube 3 of the long rib is fixed to Outer Tube 6 of the long rib when Locking Pin 5 is inserted into Groove 8; when Locking Pin 5 detaches from Groove 8, Inner Tube 3 of the long rib will move axially back and forth with respect to Outer Tube 6 of the long rib. Arrows 15 and 16 indicate the axial movement of the Inner Tube 3 relative to the Outer Tube 6 when Locking Pin 5 detaches from Groove 8.

Inner Tube 3 of the long crib is further provided with Wedge 4, which has a beveled side 4A. Locking Pin 5 is equipped with a matching beveled side 5A. The beveled side 4A of Wedge 4 matches the beveled side 5A of Locking Pin 5. The axial movement of Wedge 4 with respect to Inner Tube 3 of the long rib will drive Locking Pin 5 to move back and forth along the diameter.

The inner wall of Inner Tube 3 of the long rib is fixed with First Spring 9. One end of Locking Pin 5 faces Groove 8, while the other end of Locking Pin 5 closely abuts First Spring 9. When Wedge 4 moves to the left, the beveled side 4A of Wedge 4 pushes against the beveled side 5A of Locking Pin 5, causing First Spring 9 to be compressed, at this point and Pin End 5B of Locking Pin 5 to detach from Groove 8, thereby allowing Inner Tube 3 of the long rib to freely stretch and retract within Outer Tube 6 of the long rib. When Wedge 4 moves to the right, the beveled side 4A of Wedge 4 does not come into contact with the beveled side 5A of Locking Pin 5, and the force of First Spring 9 causes Pin End 5B of Locking Pin 5 to extend into corresponding Groove 8.

The inner wall of Inner Tube 3 of the long rib is also fixed with Fastening Block 10. Locking Pin 5 gets connected and fixed to Fastening Block 10 when it moves along the diameter. Locking Pin 5 is fixed at its position by Fastening Block 10 when it moves axially. Fastening Block 10 is equipped with a hole, where Locking Pin 5 is inserted into. Both the left and right sides of Locking Pin 5 abut against Fastening Block 10.

Inner Tube 3 of the long rib is provided with a Movable Push Rod 2. The left end of movable Push Rod 2 is connected and fixed to Wedge 4. The dimension of Movable Push Rod 2 should be proportional to that of Inner Tube 3 of the long rib. The thrust of Movable Block 1 is transmitted by Movable Push Rod 2 to Wedge 4 on the left.

The right end of Inner Tube 3 of the long rib is provided with Movable Block 1. The right end of Movable Push Rod 2 is connected and fixed to Movable Block 1. Movable Block 1 extends into Inner Tube 3 of the long rib. The user is only required to push Movable Block 1 during actual use.

Second Spring 11 is located between Fastening Block 10 and Wedge 4. The two ends of Second Spring 11 closely abut Fastening Block 10 and Wedge 4 respectively. There should be at least two Groove 8s, and the Groove 8s must be distributed axially along the inner surface of Outer Tube 6 of the long rib. The number of Groove 8s and the distance between the Groove 8s can be adjusted based on usage requirements. The right end of Outer Tube 6 of the long rib is fixed with Retractable Block 7. The movement of Wedge 4 is limited by Retractable Block 7 when it moves axially to the right.

Pushing Movable Block 1 will cause Movable Push Rod 2 to move to the left, thereby causing Wedge 4 to pan left and press down against Locking Pin 5, causing Pin End 5B of Locking Pin 5 to detach from Groove 8. At this point, Inner Tube 3 of the long rib can freely stretch and retract within Outer Tube 6 of the long rib, thereby allowing the ribs of the umbrella to stretch and retract freely.

The structure of a telescopic tube structure of an umbrella rib is adopted, which is structurally simple. The wedge with the beveled side pushes the locking pin that also has a beveled side, allowing the locking pin to detach or insert into the groove. It is very convenient to use, wherein the inner tube of the long rib remains flexibly connected when the movable block is pushed to the left, and the release of the movable block allows the inner tube and outer tube of the long rib to remain securely fixed to one another and reliably locked. The number of grooves and the distance between grooves can be adjusted to suit different needs.

In this Specification, this utility model has been described with reference to its specific embodiment. However, it is obvious that modifications and variations can still be made to the utility model without departing from its essence and scope. Therefore, this Specifications and drawings should be considered as descriptive rather than restrictive.*

What is claimed is:

1. A telescopic tube structure for an umbrella comprising:
a long rib comprising an outer tube and an inner tube;
a first end of the inner tube slidingly seated inside the outer tube;
the inner tube connected to a locking pin:
a plurality of corresponding grooves disposed on an inner surface of the outer tube;
wherein the inner tube is positionally fixed with respect to the outer tube when the locking pin is inserted into at least one of the plurality of corresponding grooves, and when the locking pin is removed from the at least one of the plurality of corresponding grooves, the inner tube is configured to move axially with respect to the outer tube.

2. The telescopic tube structure for an umbrella of claim 1,
wherein the inner tube is further provided with a wedge having a beveled side and the locking pin comprises a matching beveled side and a first end;
wherein an axial movement of the wedge with respect to the inner tube will drive the locking pin to move in a direction transverse to the axial movement.

3. The telescopic tube structure for an umbrella of claim 2, wherein the first end of the locking pin faces the plurality of grooves, while a second end of the locking pin is coupled with an inner wall of the inner tube through a first spring.

4. The telescopic tube structure for an umbrella of Claim 2, further comprising a fasting block;
wherein the fastening block is fixed to the inner wall of the inner tube and the locking pin is slidingly connected to the said fastening block and the fastening block allows the locking pin to move in the transverse direction and prevents movement of the locking pin in the axial direction.

5. The telescopic tube structure for an umbrella of claim 2, wherein the inner tube is provided with a movable push rod and a first end of the movable push rod is connected to the wedge.

6. The telescopic tube structure for an umbrella of claim 5, wherein a second end of the inner tube is provided with a movable block and a second end of the movable push rod is connected to the movable block.

7. The telescopic tube structure for an umbrella of claim 5 wherein the movable push rod is connected to the wedge by a second spring located between the wedge and the first end of the movable push rod.

8. The telescopic tube structure for an umbrella of claim 2, wherein a first end of the outer tube is fixed with a retractable block, and any movement of the wedge is limited in the axial direction by the retractable block.

9. The telescopic tube structure for an umbrella of claim 1, wherein the plurality of corresponding grooves is distributed axially along the inner surface of the outer tube.

10. A telescopic tube structure for an umbrella comprising:

a first tube having a first end and a second end;

a second tube having a first end and a second end, the first end of the second tube being configured to be slidably seated inward of the first end of the first tube;

a locking pin coupled with the second tube and disposed inside the second tube; the locking pin having an engaging end extending and outwardly from the second tube and configured to be inserted into at least one groove on the first tube;

a push rod inside the second tube, the push rod having a first end and a second end, the first end of the push rod coupled with the locking pin;

wherein when the push rod is moved axially in a first direction, the engaging end of the locking pin is moved out of the at least one groove; and when the push rod moves axially in a second direction, movement of the engaging end of the locking pin into the at least one groove is permitted.

11. An umbrella canopy rib tip assembly comprising:

a first tube and a second tube slidingly engaged together with a first end of the second tube inside of the first tube;

a plurality of corresponding grooves disposed on an inside surface of the first tube, each of the corresponding grooves comprising a groove bevel;

a locking pin disposed inside of the second tube, the locking pin comprising an engagement tip and a base, the engagement tip further comprising a bevel side;

a spring coupled with the locking pin and with an inside surface of the second tube;

wherein when the second tube is pulled in a first direction, the bevel side of the engagement tip of the locking pin slidingly engages the groove bevel of at least one of the plurality of corresponding grooves, the sliding engagement causing the spring to be compressed and disengaging the engagement tip from the at least one of the plurality of corresponding grooves to allow the second tube to move in the first direction relative to the first tube; and when a force is applied to the second tube in a second direction opposite the first direction, the engagement tip of the locking pin remains in the at least one of the plurality of grooves and prevents the movement of the second tube relative to the first tube in the second direction.

12. The umbrella canopy rib tip assembly of claim 11 further comprising a push rod disposed within the second tube, the push rod having a first end coupled with a wedge;

wherein when the push rod is pulled in the second direction the wedge transversely engages the base of the locking pin, causing the spring to be compressed and disengaging the engagement tip from the at least one of the plurality of corresponding grooves and allowing the second tube to move in the second direction relative to the first tube.

* * * * *